US005946945A

United States Patent [19]

Kegler et al.

[11] Patent Number: 5,946,945

[45] Date of Patent: Sep. 7, 1999

[54] HIGH PRESSURE LIQUID/GAS STORAGE FRAME FOR A PRESSURIZED LIQUID CLEANING APPARATUS

[76] Inventors: Andrew Kegler, 325 Hall St., Ripon, Wis. 54971-0990; Gregory L. Malchow, 1903 Scarlet Oak Tr., Oshkosh, Wis. 54904; Stephen L. Harris, 416 Shepard St., Ripon, Wis. 54971

[21] Appl. No.: 08/998,289

[22] Filed: Dec. 24, 1997

[51] Int. Cl.[6] ..... D06F 29/00

[52] U.S. Cl. ..... 68/18 R; 68/18 C; 68/183

[58] Field of Search ..... 68/18 R, 18 C, 68/3 R, 183, 207.1, 207; 8/159

[56] References Cited

U.S. PATENT DOCUMENTS

| | | | |
|---|---|---|---|
| 9,500 | 12/1852 | Knight et al. . | |
| 899,956 | 9/1908 | Coons . | |
| 1,483,663 | 2/1924 | Johnson . | |
| 1,925,462 | 9/1933 | Rosenbaum . | |
| 3,982,284 | 9/1976 | Becker | 4/145 |
| 4,601,181 | 7/1986 | Privat | 68/18 C |
| 5,467,492 | 11/1995 | Chao et al. | 8/159 |
| 5,469,876 | 11/1995 | Gray et al. | 134/105 |
| 5,651,276 | 7/1997 | Purer et al. | 68/5 C |
| 5,702,535 | 12/1997 | Gray et al. | 134/10 |

*Primary Examiner*—Frankie L. Stinson
*Assistant Examiner*—Paul J. Lee
*Attorney, Agent, or Firm*—Leydig, Voit & Mayer, Ltd.

[57] ABSTRACT

A pressure vessel for receiving and storing pressurized fluid in a pressurized dense phase liquid dry cleaning apparatus is provided. The dry cleaning apparatus generally includes a cleaning vessel within which garments or the like are cleaned and a solvent recovery device which takes the contaminated cleaning fluid from the cleaning vessel and separates out the contaminants. The pressure vessel comprises a plurality of interconnected hollow structures and as such is substantially self-supporting and occupies less space within dry cleaning apparatus. The pressure vessel can also serve as the support structure for the other components of the dry cleaning system to provide a further cost and space savings.

19 Claims, 4 Drawing Sheets

HIGH PRESSURE LIQUID/GAS STORAGE FRAME FOR A PRESSURIZED LIQUID CLEANING APPARATUS

FIELD OF THE INVENTION

This invention generally relates to pressurized liquid cleaning apparatus and, more particularly, to a high pressure liquid/gas storage frame for a pressurized dense phase liquid dry cleaning apparatus.

BACKGROUND OF THE INVENTION

Known dry-cleaning processes consist of a wash, rinse, and drying cycle with solvent recovery. Garments are loaded into a basket in a cleaning drum and immersed in a dry-cleaning fluid or solvent, which is pumped into the cleaning drum from a base tank. Conventional dry-cleaning fluids include perchloroethylene (PCE), petroleum-based or Stoddard solvents, CFC-113, and 1,1,1-trichloroethane, all of which are generally aided by a detergent. The solvent is used to dissolve soluble contaminants, such as oils, and to entrain and wash away insoluble contaminants, such as dirt.

The use of these conventional solvents, however, poses a number of health and safety risks as well as being environmentally hazardous. For example, halogenated solvents are known to be environmentally unfriendly, and at least one of these solvents, PCE, is a suspected carcinogen. Known petroleum-based solvents are flammable and can contribute to the production of smog. Accordingly, dry cleaning systems which utilize dense phase fluids, such as liquid carbon dioxide, as a cleaning medium have been developed. An apparatus and method for employing liquid carbon dioxide as the dry-cleaning solvent is disclosed in U.S. Pat. No. 5,467,492, entitled "Dry-Cleaning Garments Using Liquid Carbon Dioxide Under Agitation As Cleaning Medium". A similar dry cleaning apparatus is also disclosed in U.S. Pat. No. 5,651,276.

These systems pose a number of other problems, particularly in relation to the high operating pressures necessary for maintaining the gas in a liquid state. For example, the various pressurized components of the system must be constructed with thick, heavy walled structures to withstand the elevated pressures encountered during the dry cleaning operation. This, however, increases both the material cost of these components and the structures necessary to support these components.

The dry-cleaning industry is a highly competitive market which primarily consists of small neighborhood operations. Accordingly, maintaining the costs of a liquid carbon dioxide dry cleaning system as low as possible is extremely important. In addition, due to the "neighborhood" nature of many dry cleaning operations there are significant space limitations on the equipment. Thus, while maintaining the cost and space requirements to a minimum is always an important object, it is particularly critical with dry cleaning equipment.

One of the most critical components in a liquid carbon dioxide dry cleaning system both in terms of cost and space restrictions are the tanks and vessels within which the carbon dioxide is stored. Since these tanks must keep the carbon dioxide at a high pressure (e.g. 500–850 psi) under ambient temperature conditions, heavy walled pressure vessels are required. In addition, since the pressure vessels must be capable of storing a substantial quantity of liquid carbon dioxide, relatively large pressure vessels must be used. As the cost of conventional cylindrical pressure vessels generally increases linearly with their capacity, the cost of the pressure vessels alone in a liquid carbon dioxide dry cleaning system may make conversion to such a system prohibitively expensive for many dry cleaner operators. In addition, conventional pressure vessels which meet these requirements are quite bulky and heavy. Accordingly, a significant amount of space within the dry cleaning apparatus must be committed exclusively to the pressure vessels. Moreover, relatively expensive support framing, which takes up even more space, also must be provided.

OBJECTS AND SUMMARY OF THE INVENTION

Accordingly, in view of the foregoing, it is a general object of the present invention to overcome the problems associated with using conventional pressure vessels in pressurized dense phase liquid dry cleaning systems.

A more specific object of the present invention is to provide a pressure vessel for use in a pressurized dense phase liquid dry cleaning apparatus which substantially reduces material and assembly costs and which occupies less space within the dry cleaning apparatus.

Another object of the present invention is to provide a relatively inexpensive pressure vessel as characterized above which is substantially self-supporting such that it does not require any expensive support structures.

A related object is to provide a pressure vessel of the foregoing type which can serves as part of the support structure for a pressurized dense phase liquid dry cleaning apparatus.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
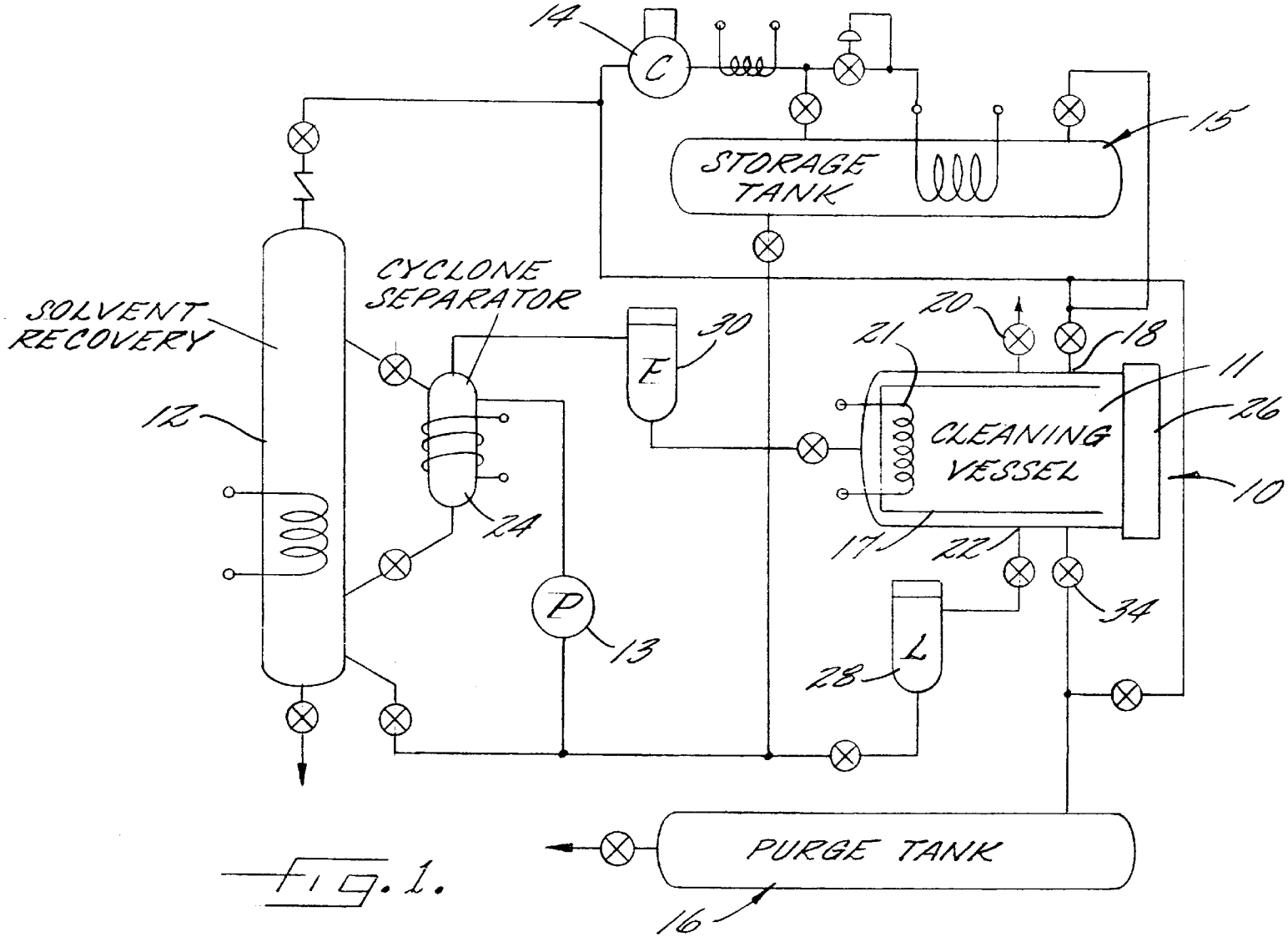
FIG. 1 is a schematic block diagram of an illustrative dense phase liquid dry cleaning apparatus having a pressure vessel constructed in accordance with the teachings of the present invention.
Figure 2:
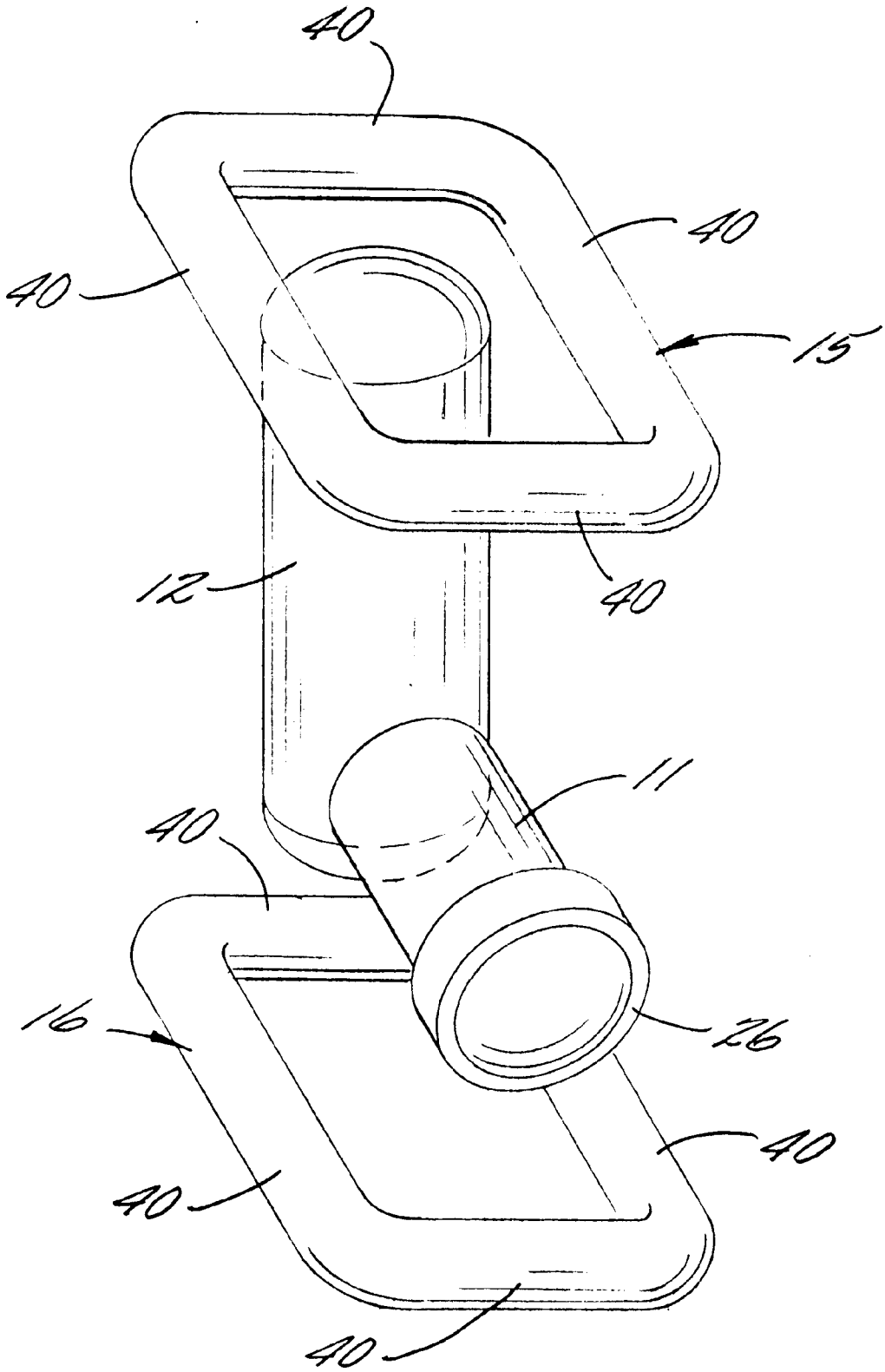
FIG. 2 is a perspective schematic view of the illustrative liquid carbon dioxide dry cleaning apparatus.

Referring now more particularly to FIG. 1, there is shown a schematic block diagram of an illustrative dry-cleaning apparatus 10 which includes an associated pressure vessel in accordance with the present invention. As is described in more detail below, the illustrative dry-cleaning apparatus 10 utilizes liquid carbon dioxide as the dry-cleaning solvent in much the same manner as is described in U.S. Pat. Nos. 5,467,492 and 5,651,276. While the present invention is described in connection with a liquid carbon dioxide dry cleaning apparatus, which has particular use in cleaning garments, it will be readily appreciated that it is equally applicable to other types of cleaning processes which utilize a pressurized cleaning fluid. Moreover, the present invention could also be applied in other contexts, including other systems which store pressurized fluids or gases.

The major components of the dry-cleaning apparatus 10 include a substrate cleaning vessel 11 having a door 26 which permits access to the interior of the vessel, a solvent recovery device 12, a pump 13, and a compressor 14 all of which may be of a conventional type. The dry cleaning apparatus 10 also includes a pair of storage vessels or tanks which receive and store pressurized liquid carbon dioxide. One of these is configured and arranged to function as a storage tank 15 for the supply of liquid carbon dioxide to the cleaning vessel 11 and the other is arranged to function as a purge tank 16. As will be described in detail below, both the storage tank 15 and the purge tank 16 have a unique and novel configuration which enables these tanks to be substantially self-supporting and occupy less space within the dry cleaning apparatus 10. Additionally, these tanks can also serve as the support structure for the other components of the dry cleaning apparatus to provide a further cost and space savings.

Figure 4:
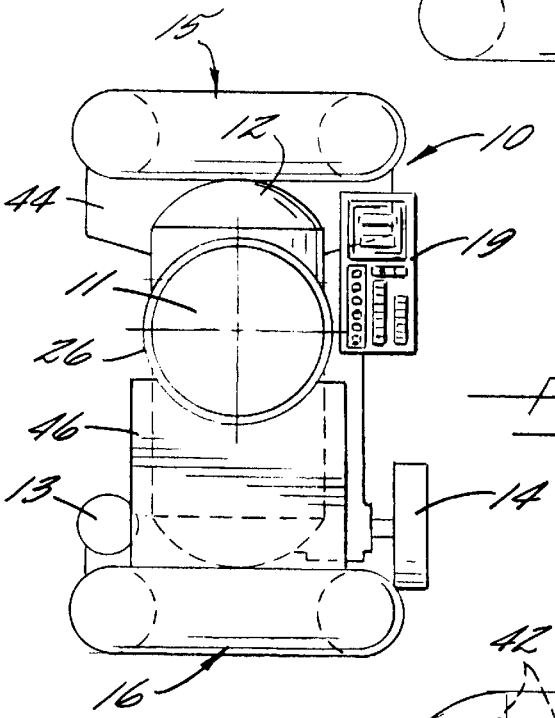
FIG. 4 is a front elevation view of the illustrative liquid dry cleaning apparatus.
Figure 5:
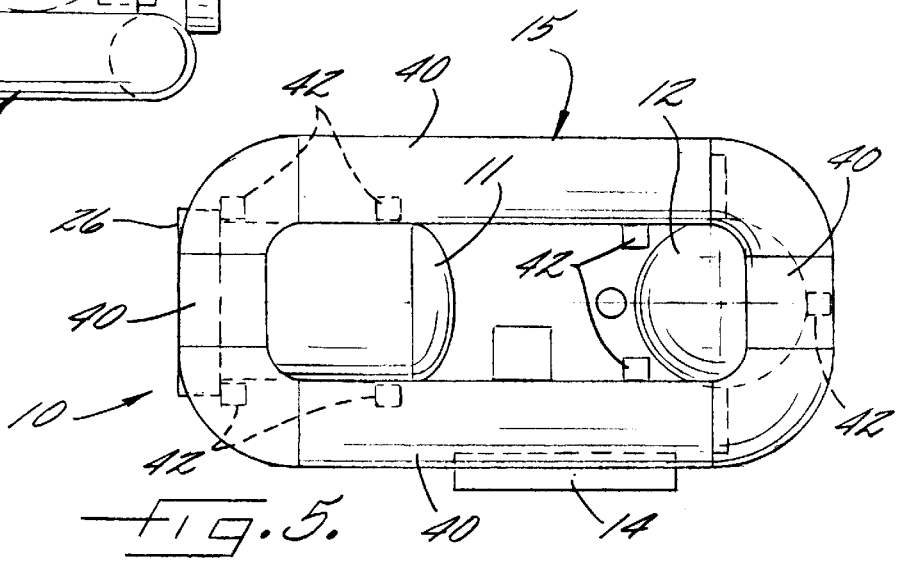
FIG. 5 is a top plan view of the illustrative dry cleaning apparatus.

To begin the dry cleaning process, soiled garments or other items to be dry cleaned are deposited in a perforated rotatable basket 17 which is supported in the cleaning vessel 11. The door 26 to the cleaning vessel 11 is then closed and the vessel charged with liquid carbon dioxide from the pressurized storage tank 15 through the inlet 18 in order to initiate the wash cycle. This and various other aspects of the cleaning process may be initiated and monitored through a control panel 19 (FIG. 4). Once charged with the liquid carbon dioxide, agitation may be applied to clean the items, to speed up the cleaning in general, aid in the removal of any insoluble soils, and to reduce the possibility of re-disposition of contaminants. This agitation may be accomplished by rotation of the basket 17 and/or by the direction of liquid carbon dioxide into the interior of the basket, as disclosed in commonly assigned U.S. application Ser. No. 08/998,399, filed Dec. 24, 1997. During the wash and rinse cycles, soluble contaminants dissolve in the liquid carbon dioxide. Once the wash and rinse cycles have been completed, the now contaminated liquid carbon dioxide is drained from the cleaning vessel during a drying/draining cycle.

For ensuring that the carbon dioxide is maintained in a liquid phase during cleaning, the cleaning vessel 11 may be further equipped with a pressure check valve 20, heat exchanger 21, pressure sensor, and temperature sensor to aid in temperature and pressure control of the carbon dioxide in the cleaning vessel 11. In order to effectively remove the contaminants from the items, the liquid carbon dioxide must be at a temperature at which the contaminants are substantially soluble. Accordingly, when liquid carbon dioxide is used, the desired pressure in the cleaning vessel 11 ranges from about 700 psi (48 bar) to about 850 psi (59 bar) while the temperature ranges from about 55° F. (13° C.) to about 80° F. (24° C.). At greater temperatures and pressures, the carbon dioxide will be in a supercritical fluidic state, and may be too aggressive for some dry-cleaning applications. When the system is used to clean garments, it is desirable to maintain the temperature above 32° F. as any drop below this critical temperature may cause damage to the garments.

For removing contaminants from the liquid carbon dioxide during the wash and rinse cycles, the liquid carbon dioxide preferably is cycled from the cleaning vessel 11 through outlet 22 to the solvent recovery device 12, which in the illustrated embodiment is configured as a still. The solvent recovery device 12 functions to vaporize the liquid carbon dioxide to separate and concentrate the particulates. During such processing, the clean gaseous carbon dioxide is directed to a condenser (not shown) where it is reliquified and then returned to the storage tank 15. Alternatively, the particulates may be removed from the liquid carbon dioxide by cooling the liquid to a point where the solvent capabilities of the liquified carbon dioxide do not allow the particulates to remain suspended, as disclosed in co-assigned application Ser. No. 08/998,392 filed Dec. 24, 1997. In order to provide a continuous separation of particles, for example from 20 to 100 microns, from the liquid stream, a cyclone separator 24 is provided. The separated particles are gravity fed from the cyclone separator 24 into the base of the solvent recovery device 12 where they can be removed as desired.

In order to circulate the liquified carbon dioxide through the apparatus, a pump 13 is provided. The pump 13 is used to transfer liquified carbon dioxide between the storage tank 15, the solvent recovery device 12, the cyclone separator 24 and/or the cleaning vessel 11. In order to protect the pump 13 from large particles for example, those greater than 40 microns, a lint trap 28 is provided. Preferably, the lint trap 28 is equipped with a removable inner basket to allow for easy access and to additionally provide a container within which detergent, surfacant, soap or the like may be dissolved into the cleaning solution as the wash cycle progresses. A filter 30 is also provided to remove finer particles, for example, 1 to 20 microns.

For removing gaseous carbon dioxide from the cleaning vessel 11, a compressor 14 is provided to pump gaseous carbon dioxide from the cleaning vessel 11 to a condensor (not shown) where it is condensed back into liquid phase and then redirected to the storage tank 15. It will be appreciated that during the wash and rinse cycles gaseous carbon dioxide may be released from the cleaning liquid and accumulate within the cleaning vessel 11. The gaseous carbon dioxide typically is evacuated from the cleaning vessel 11 and directed to the condensor during the washing and rinse cycles and upon completion of the washing operation prior to opening the cleaning vessel and removing the cleaned items. As understood by one skilled in the art, pumping gaseous carbon dioxide from the pressurized cleaning vessel 11 will reduce the internal pressure within the cleaning chamber with a resultant temperature decrease. Accordingly, an auxiliary heater may be provided in order to compensate for such temperature decrease and maintain the required temperature level within the pressurized cleaning vessel 11. Alternatively, the compressor 14 may be mounted in close proximity to the cleaning vessel 11 so that heat generated by the compressor 14 during its operation may be directly utilized by the cleaning vessel for maintaining the desired temperature level within the vessel, without the use of auxiliary heaters as disclosed in commonly assigned U.S. application Ser. No. 08/998,219, filed Dec. 24, 1997.

In order to control the pressure and temperature within the cleaning vessel 11, carbon dioxide may be quickly discharged from the cleaning vessel 11 to the purge tank 16 through valve 34 without the need for the compressor 14. While not related to pressure or temperature control, it is also noted that the purge tank 16 provides a source of low pressure, gaseous carbon dioxide which can be used to purge the cleaning vessel 11 of air before the wash cycle is commenced. As will be appreciated, the purge tank 16 can also be used in conjunction with the compressor 14 to provide a pressure drop in order to provide cooling as necessary to any component of the apparatus 10 by taking advantage of the refrigerative properties of the carbon dioxide.

Figure 6:
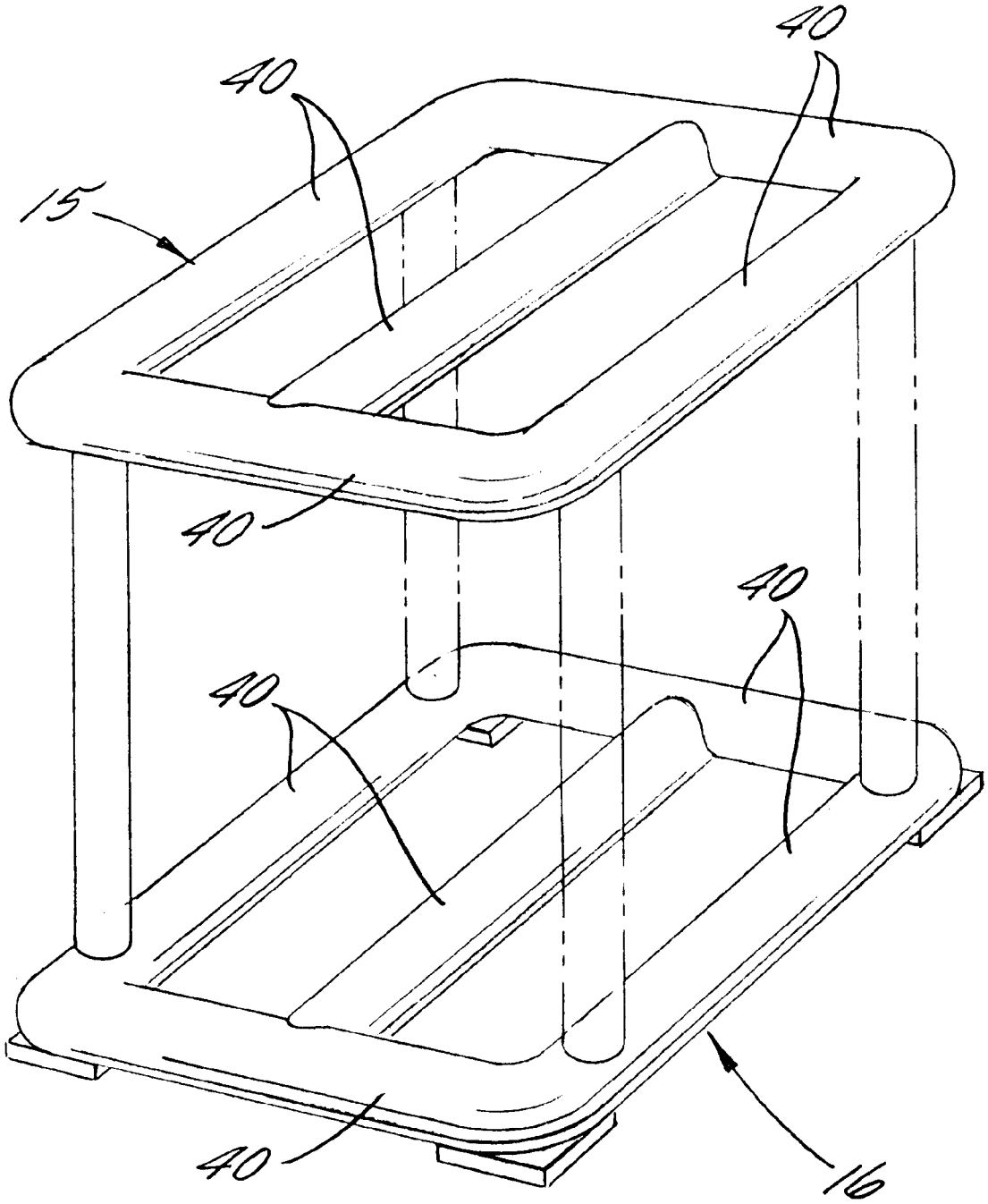
FIG. 6 is a perspective view of an alternative embodiment of a pressure vessel constructed in accordance with the teachings of the present invention for use in the illustrative dry cleaning apparatus.

In accordance with the invention, the storage tank 15 and the purge tank 16 have a space saving configuration which also makes them substantially self-supporting. In particular, as shown in FIGS. 2–5, the purge tank 16 and storage tank 15 each comprises a plurality of interconnected hollow members or structures 40, which in the illustrated embodiment are tubular members or pipes. In the case of both the storage and purge tanks 15, 16, the hollow members 40 are arranged in a horizontal substantially co-planar configuration. This configuration provides inherent structural stability which allows the tanks to serve as their own frame and thus eliminates the need to provide any expensive and space consuming support structures for the purge and storage tanks. In the embodiment shown in FIGS, 2–5, each tank includes four hollow members 40 generally arranged in a rectangle. It will be appreciated, however, that other configurations and arrangements of the hollow structures 40 could also be used including, for example, arranging the hollow members 40 in a grid pattern such as shown in FIG. 6 or a triangle or even a three dimensional box.

Using such a configuration also offers other significant advantages. For example, it enables the storage and purge tanks 15, 16 to be positioned, with reference to the illustrated embodiment, respectively above and below the other components of the dry cleaning apparatus 10 in order to save space. It has been found that using this configuration for the storage and purge tanks 15, 16 can result in a space savings of up to fifty percent as compared to using conventional pressure vessels. Of course, it will be appreciated that the position of the storage and purge tanks 15, 16 could be reversed or one of the tanks could be eliminated. This construction or configuration also enables the tanks to be built from readily available materials and thereby provides a significant material cost advantage over conventional pressure vessels. For example, in one presently contemplated embodiment, the hollow members 40 can consist simply of about 12 inch to about 16 inch diameter schedule 60–80 pipe.

Figure 3:
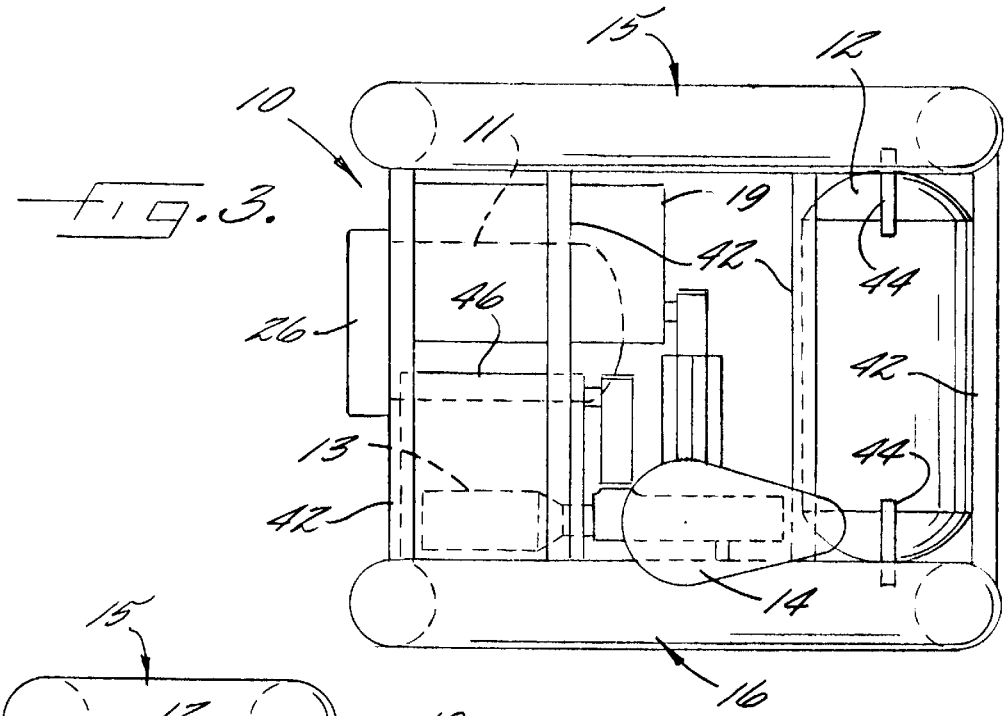
FIG. 3 is a side elevation view of the illustrative liquid carbon dioxide dry cleaning apparatus.

In accordance with a further aspect of the invention, the storage and purge tanks 15, 16 can be used as the structural framework for other components of the dry cleaning apparatus to provide further cost and space savings. In particular, the structurally stable configuration and the relatively thick, heavy walls of the hollow members 40 that are necessary to withstand the elevated pressures of the liquid carbon dioxide enables the tanks to be arranged to serve a double duty as part of the support structure for the dry cleaning apparatus 10. Accordingly, the need for a costly separate support structure is eliminated. In the illustrated embodiment, the purge tank 16 serves as the lower frame structure and the storage tank 15 serves as the upper frame structure. Since the storage tank 15 is positioned above the cleaning vessel 11 in this configuration, there is the additional advantage that the liquid carbon dioxide gains several extra pounds of pressure. As best shown in the schematic illustration of FIG. 2, the cleaning vessel 11 and the solvent recovery device 12, the two largest components of the dry cleaning apparatus 10, can be arranged interposed in the framework defined by the storage and purge tanks 15, 16. This framework further includes a plurality of vertical structural members 42 (FIGS. 3 and 5) extending between the upper storage tank 15 and lower purge tank 16. Opposing pairs of these structural members 42 are arranged along the respective sides of the dry cleaning apparatus 10 and support the storage tank 15 on the purge tank 16. Additional support for the upper storage tank 15 is provided by the generally cylindrical solvent recovery device 12 which is arranged in an upright position at the rear of the dry cleaning apparatus 10. As shown in FIG. 3, the solvent recovery device 12 is tied into the storage and purge tanks 15, 16 by brackets 44.

In order to support the cleaning vessel 11 in an accessible position at the front of the dry cleaning apparatus, an upwardly extending cradle 46 (best shown in FIG. 4) is arranged on the purge tank 16 adjacent the front of the dry cleaning apparatus 10. From this position garments or other items can be easily loaded or unloaded from the cleaning vessel 11. The pump 13 and the compressor 14, the two remaining major components of the dry cleaning apparatus 10 in terms of size, are arranged on the purge tank 16 on opposing sides of the dry cleaning apparatus 10 as best shown in FIG. 4. It will be appreciated that the support framework also could comprise alternative configurations of the purge and storage tanks. For example, instead of being arranged horizontally, the purge tank and the storage tank could be arranged vertically (essentially stood on end) on either side of the other components such that the tanks serve as the "walls" of the dry cleaning apparatus. A further space savings may be achieved by equipping the cleaning vessel 11 with a door opening and closing apparatus which, instead of swinging the door 26 into an open position, moves the door 26 horizontally away from the cleaning vessel 11 and then lowers it into the open position as disclosed in commonly assigned U.S. application Ser. No. 08/998,394, filed Dec. 24, 1997.

From the foregoing it can be seen that the unique configuration of the storage tank 15 and purge tank 16 substantially reduces the material and assembly costs associated with a dense phase liquid dry cleaning apparatus. Additionally, as the tanks are substantially self-supporting the need to provide expensive support structures for the tanks is eliminated. Finally, the inherent structural stability of the purge and storage tanks makes them useable as the support structure or framework for other components of the dry cleaning apparatus.

What is claimed is:

1. An apparatus for removing a contaminant from a substrate using a pressurized cleaning fluid comprising, in combination:

a substrate cleaning vessel having an inlet for introducing substantially uncontaminated pressurized cleaning fluid and an outlet for removing a solution of the contaminant in the pressurized cleaning fluid;

a cleaning fluid recovery device for separating the contaminant from the cleaning fluid to provide substantially uncontaminated cleaning fluid at a recovery device outlet, the cleaning fluid recovery device being in fluid communication with the substrate cleaning vessel through the cleaning vessel outlet; and a structural framework supporting the substrate cleaning vessel and the solvent recovery device comprising a plurality of interconnected hollow structures in fluid communication with the substrate cleaning vessel for receiving and storing the pressurized cleaning fluid.

2. The apparatus according to claim 1 wherein the plurality of interconnected hollow structures are arranged below the substrate cleaning vessel and the solvent recovery device.

3. The apparatus according to claim 2 wherein the plurality of hollow structures are arranged in a generally rectangular configuration.

4. An apparatus for removing a contaminant from a substrate using a pressurized cleaning fluid comprising, in combination:

a substrate cleaning vessel having an inlet for introducing substantially uncontaminated pressurized cleaning fluid and an outlet for removing a solution of the contaminant in the pressurized cleaning fluid;

a cleaning fluid recovery device for separating the contaminant from the cleaning fluid to provide substantially uncontaminated cleaning fluid at a recovery device outlet, the cleaning fluid recovery device being in fluid communication with the substrate cleaning vessel through the cleaning vessel outlet; and a pressurized fluid storage vessel in fluid communication with the cleaning vessel inlet for receiving and storing the pressurized cleaning fluid, the storage vessel comprising a plurality of interconnected hollow structures arranged below the substrate cleaning vessel and cleaning fluid recovery device.

5. The apparatus according to claim 4 wherein the plurality of interconnected hollow structures have a generally coplanar configuration.

6. The apparatus according to claim 4 wherein the plurality of interconnected hollow structures are arranged in a generally rectangular configuration.

7. The apparatus according to claim 4 wherein the plurality of hollow structures comprise a storage vessel for substantially uncontaminated pressurized cleaning which is in fluid communication with the substrate cleaning vessel inlet and the solvent recovery outlet.

8. The apparatus according to claim 4 wherein the plurality of hollow structures comprise a purge tank in fluid communication with the substrate cleaning vessel.

9. The apparatus according to claim 4 wherein each of the hollow structures has a tubular configuration.

10. An apparatus for removing a contaminant from a substrate using a pressurized cleaning fluid comprising, in combination:

a substrate cleaning vessel having an inlet for introducing substantially uncontaminated pressurized cleaning fluid and an outlet for removing a solution of the contaminant in the pressurized cleaning fluid, a cleaning fluid recovery device for separating the contaminant from the cleaning fluid to provide substantially uncontaminated cleaning fluid at a recovery device outlet, the cleaning fluid recovery device being in fluid communication with the substrate cleaning vessel through the cleaning vessel outlet, and a pressurized fluid storage vessel in fluid communication with the cleaning vessel inlet for receiving and storing the pressurized cleaning fluid, the storage vessel comprising a plurality of interconnected hollow structures arranged above the substrate cleaning vessel and cleaning fluid recovery device.

11. The apparatus according to claim 10 wherein the plurality of interconnected hollow structures have a generally coplanar configuration.

12. The apparatus according to claim 10 wherein the plurality of interconnected hollow structures are arranged in a generally rectangular configuration.

13. The apparatus according to claim 10 wherein each of the hollow structures has a tubular configuration.

14. An apparatus for removing a contaminant from a substrate using a pressurized cleaning fluid comprising, in combination:

a substrate cleaning vessel having an inlet for introducing substantially uncontaminated pressurized cleaning fluid and an outlet for removing a solution of the contaminant in the pressurized cleaning fluid;

a cleaning fluid recovery device for separating the contaminant from the cleaning fluid to provide substantially uncontaminated cleaning fluid at a recovery device outlet, the cleaning fluid recovery device being in fluid communication with the substrate cleaning vessel through the cleaning vessel outlet; and a structural framework supporting the substrate cleaning vessel and the solvent recovery device comprising a plurality of interconnected hollow structures in fluid communication with the substrate cleaning vessel for receiving and storing the pressurized cleaning fluid wherein the plurality of hollow structures includes a first group of interconnected hollow structures arranged above the substrate cleaning vessel and the solvent recovery device and a second group of a interconnected hollow structures arranged below the substrate cleaning vessel and the solvent recovery device.

15. The apparatus according to claim 14 wherein both the first and second groups of interconnected hollow structures are arranged in a generally rectangular configuration.

16. The apparatus according to claim 14 wherein the second group of interconnected hollow structures are supported on the first group of interconnected hollow structures by at least one structural member.

17. The apparatus according to claim 14 wherein the second group of interconnected hollow structures comprise a storage vessel for substantially uncontaminated pressurized cleaning fluid which is in fluid communication with the substrate cleaning vessel inlet and the solvent recovery device outlet.

18. The apparatus according to claim 17 wherein the first group of interconnected hollow structures comprise a purge tank which is fluid communication with the cleaning vessel.

19. An apparatus for removing a contaminant from a substrate using a pressurized cleaning fluid comprising, in combination:

a substrate cleaning vessel having an inlet for introducing substantially uncontaminated pressurized cleaning fluid and an outlet for removing a solution of the contaminant in the pressurized cleaning fluid, a cleaning fluid recovery device for separating the contaminant from the cleaning fluid to provide substantially uncontaminated cleaning fluid at a recovery device outlet, the cleaning fluid recovery device being in fluid communication with the substrate cleaning vessel through the cleaning vessel outlet, and a pressurized fluid storage vessel in fluid communication with the cleaning vessel inlet for receiving and storing the pressurized cleaning fluid, the storage vessel comprising a plurality of interconnected hollow structures arranged above the substrate cleaning vessel and cleaning fluid recovery device wherein the plurality of interconnected hollow structures comprise a storage vessel for substantially uncontaminated pressurized cleaning which is in fluid communication with the substrate cleaning vessel inlet and the solvent recovery outlet.

* * * * *